US009098102B2

(12) United States Patent
Kadowaki et al.

(10) Patent No.: US 9,098,102 B2
(45) Date of Patent: Aug. 4, 2015

(54) REFERENCE VOLTAGE GENERATING CIRCUIT

(71) Applicant: KABUSHIKI KAISHA TOSHIBA, Tokyo (JP)

(72) Inventors: Hirokazu Kadowaki, Fujisawa (JP); Hideaki Miyoshi, Kawasaki (JP); Akihiro Tanaka, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 14/278,411

(22) Filed: May 15, 2014

(65) Prior Publication Data

US 2015/0160678 A1 Jun. 11, 2015

(30) Foreign Application Priority Data

Dec. 5, 2013 (JP) ..... 2013-252159

(51) Int. Cl.
*G05F 3/16* (2006.01)
*G05F 3/24* (2006.01)

(52) U.S. Cl.
CPC . *G05F 3/16* (2013.01); *G05F 3/245* (2013.01)

(58) Field of Classification Search
CPC ..... G05F 3/30; G05F 3/20; G05F 3/245
USPC ..... 323/313
See application file for complete search history.

(56) References Cited

U.S. PATENT DOCUMENTS 5,422,563 A * 6/1995 Pflueger ..... 323/312
5,432,432 A * 7/1995 Kimura ..... 323/313
5,448,159 A * 9/1995 Kojima et al. ..... 323/315
6,005,378 A * 12/1999 D'Angelo et al. ..... 323/313
6,078,206 A * 6/2000 Watarai ..... 323/313
6,552,603 B2 4/2003 Ueda
7,301,322 B2 * 11/2007 Choi ..... 323/315
7,719,346 B2 5/2010 Imura
8,212,545 B2 7/2012 Imura
2003/0052661 A1 * 3/2003 Tachimori ..... 323/313
2009/0091311 A1 * 4/2009 Kang ..... 323/313
2009/0121698 A1 * 5/2009 Harvey ..... 323/313
2013/0200878 A1 * 8/2013 Kalb et al. ..... 323/313

FOREIGN PATENT DOCUMENTS

JP 2007-226710 A 9/2007
JP 2008-070953 A 3/2008
JP 2011-113321 A 6/2011

* cited by examiner

*Primary Examiner* — Jue Zhang

(74) *Attorney, Agent, or Firm* — Patterson & Sheridan, LLP

(57) ABSTRACT

A reference voltage generating circuit includes a first switching element having a first end connected to a first terminal, and a second end short-circuited to a control end thereof, and a second switching element having a first end, a second end connected to the second end of the first switching element, and a control end to which a bias voltage is applied. The reference voltage generating circuit further includes a third switching element having a first end short-circuited to a control end thereof and connected to a reference voltage output terminal, and a second end connected to the first end of the second switching element, a bias voltage generating section, and a fourth switching element having a first end connected to a second terminal, a second end to which the bias voltage is applied, and a control end connected to the control end of the third switching element.

20 Claims, 2 Drawing Sheets

REFERENCE VOLTAGE GENERATING CIRCUIT

CROSS-REFERENCE TO RELATED APPLICATION

This application is based upon and claims the benefit of priority from Japanese Patent Application No. 2013-252159, filed Dec. 5, 2013, the entire contents of which are incorporated herein by reference.

FIELD

Embodiments described herein generally relate to a reference voltage generating circuit.

BACKGROUND

A reference voltage generating circuit is a circuit for generating a reference voltage used in a linear regulator or the like. In the reference voltage generating circuit, it is desirable to suppress a change in the generated reference voltage as much as possible even when a temperature of an element that makes up part of the reference voltage generating circuit changes.

DETAILED DESCRIPTION

Embodiments provide a reference voltage generating circuit that may suppress a temperature dependency of a reference voltage generated thereby.

In general, according to one embodiment, a reference voltage generating circuit includes: a first switching element of a first conductivity type having a first end connected to a first terminal, and a second end short-circuited to a control end thereof; a second switching element of a normally-on type and of a second conductivity type having a first end, a second end connected to the second end of the first switching element, and a control end to which a bias voltage is applied; a third switching element of a normally-on type and of a second conductivity type having a first end short-circuited to a control end thereof and connected to a reference voltage output terminal, and a second end connected to the first end of the second switching element; a bias voltage generating section configured to generate the bias voltage lower than the reference voltage from the reference voltage; and a fourth switching element of a normally-off type and of a second conductivity type having a first end connected to a second terminal, a second end to which the bias voltage is applied, and a control end connected to the control end of the third switching element.

Hereinafter, exemplary embodiments are specifically explained by reference to drawings.

Figure 1:
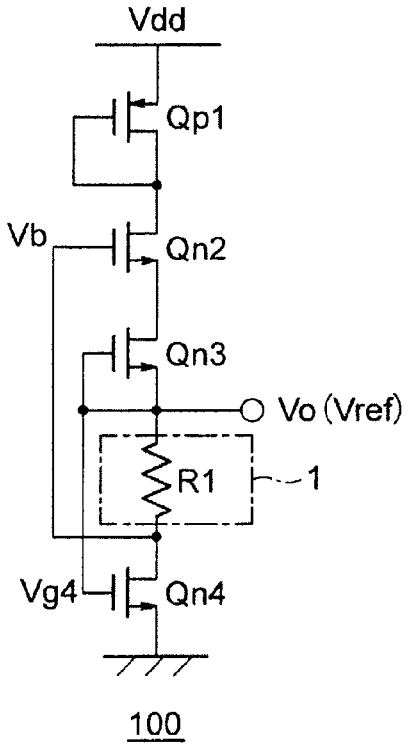
FIG. 1 is a circuit diagram illustrating a reference voltage generating circuit according to one embodiment.

FIG. 1 is a circuit diagram of a reference voltage generating circuit 100 according to one embodiment. The reference voltage generating circuit 100 includes: a p-type (first conductivity type) MOS (Metal Oxide Semiconductor) transistor (first switching element) Qp1; a depletion n-type (second conductivity type) MOS transistor (second switching element) Qn2; a depletion-type nMOS transistor (third switching element) Qn3; a resistance element R1; and an enhancement-type nMOS transistor (fourth switching element) Qn4.

A source electrode (first end) of the transistor Qp1 is connectable to a power source terminal. The power source terminal is a terminal to which a power source voltage (first power source) Vdd of 5 V, for example, is applied. The transistor Qp1 is a transistor having a diode connection where a gate electrode (control end) and a drain electrode (second end) are short-circuited to each other.

A drain electrode (second end) of the transistor Qn2 is connected to the drain electrode (second end) of the transistor Qp1. A bias voltage Vb described later is applied to a gate electrode (control end) of the transistor Qn2.

A drain electrode (second end) of the transistor Qn3 is connected to a source electrode (first end) of the transistor Qn2. A gate electrode (control end) and a source electrode (first end) of the transistor Qn3 are short-circuited to each other, and a reference voltage Vref is outputted to an output terminal Vo. The reference voltage Vref is 4.5 V, for example.

The resistance element R1 is an example of a bias voltage generating section 1 that constitutes one of technical features of this embodiment. The resistance element R1 includes a first terminal connected to the gate electrode of the transistor Qn3 (that is, the output terminal Vo), and a second terminal connected to the gate electrode of the transistor Qn2. The resistance element R1 outputs a bias voltage Vb expressed by the following formula (I) from the second terminal.

$$Vb = Vref - r * I0 \quad (1)$$

Here, r is a resistance value of the resistance element R1, and I0 is a current value of an electric current that flows in the resistance element R1. That is, the resistance element R1 that constitutes the bias voltage generating section 1 generates a bias voltage Vb that is lower than a reference voltage Vref based on the reference voltage Vref. The bias voltage Vb is applied to the gate electrode of the transistor Qn2.

In this manner, it is unnecessary to apply a bias voltage Vb from the outside. Further, the resistance element R1 may generate a desired bias voltage Vb that is lower than the reference voltage Vref by adjusting a resistance value r. Further, as will be explained later, temperature dependency of a reference voltage Vref may be suppressed by providing the resistance element R1.

A drain electrode (second end) of the transistor Qn4 is connected to the second terminal of the resistance element R1, and a bias voltage Vb is applied to the drain electrode of the transistor Qn4. A gate electrode (control end) of the transistor Qn4 is connected to the gate electrode of the transistor Qn3 (that is, the output terminal Vo). A source electrode (first end) of the transistor Qn4 is connectable to a ground terminal (second reference voltage terminal). The ground terminal is a terminal to which a ground voltage (second voltage) is applied. The transistor Qn4 has a temperature characteristic that cancels a temperature characteristic of the transistor Qn3.

The manner of operation of the reference voltage generating circuit 100 illustrated in FIG. 1 is explained hereinafter.

The gate electrode of the transistor Qn3 is short-circuited to the source electrode thereof. That is, a gate-source voltage Vgs3 of the transistor Qn3 is 0 (Vgs3=0). Since the transistor Qn3 is a depletion (normally-on) type transistor, the transistor Qn3 is turned on and an electric current I0 flows toward a source region from a drain region.

The electric current I0 flows into the transistor Qn4 through the resistance element R1. Accordingly, a voltage Vg4 for causing the electric current I0 to flow is generated at a gate electrode of the transistor Qn4. The voltage Vg4 becomes a reference voltage Vref.

Then, the resistance element R1 supplies a bias voltage Vb expressed by the formula (I) to the gate electrode of the transistor Qn2. In the transistor Qn2, a gate voltage becomes lower than a source voltage. However, the transistor Qn2 is also a depletion-type transistor and hence, the transistor Qn2 is turned on even in such a case. As a result, a constant electric current I0 is stably supplied to the transistor Qn3 from the power source terminal through the transistors Qp1, Qn2.

In this manner, the reference voltage generating circuit 100 generates a reference voltage Vref.

In the above-mentioned circuit constitution, by providing the transistors Qp1, Qn2, it is possible to suppress the influence of a change in power source voltage Vdd on a reference voltage Vref. This suppression in the influence of a change in power source voltage Vdd is explained hereinafter.

The transistor Qp1 of a diode connection is regarded as a resistance and hence, a voltage applied to the drain electrode of the transistor Qn2 becomes lower than a power source voltage Vdd. Accordingly, a change in drain voltage of the transistor Qn2 when the power source voltage Vdd changes may be made relatively small as compared to a case where the transistor Qp1 is not provided.

Further, the transistor Qn2 constitutes a source follower. Since an impedance of the source electrode of the transistor Qn2 is low, even when a drain voltage of the transistor Qn2 changes more or less, a source voltage of the transistor Qn2 scarcely changes. Accordingly, a drain voltage of the transistor Qn3 that is connected to the source electrode of the transistor Qn2 also barely changes.

That is, even when a power source voltage Vdd changes, a change in drain voltage of the transistor Qn3 is small and hence, a change in electric current I0 that flows in the transistor Qn3 may be suppressed.

When only the transistor Qp1 is provided and the transistor Qn2 is not provided, there is a possibility that temperature dependency of a reference voltage Vref is increased. That is, when a temperature is increased, a gate-source voltage of the transistor Qp1 is decreased so that an electric current that flows in the transistor Qp1 is decreased. Accordingly, a drain voltage of the transistor Qp1 is increased and this drain voltage is directly applied to the drain electrode of the transistor Qn3. As a result, an electric current I0 that flows in the transistor Qn3 is increased so that the reference voltage Vref is increased.

To the contrary, by providing the transistor Qn2 that constitutes a source follower, as described above, a source voltage of the transistor Qn2 barely changes. Accordingly, a drain voltage of the transistor Qn3 also barely changes and hence, it is possible to suppress a change in electric current I0 that flows in the transistor Qn3.

Further, by providing the transistors Qn3, Qn4, it is possible to suppress a change in reference voltage Vref that occurs along with a change in temperature. The suppression in the dependency of reference voltage Vref on temperature is explained hereinafter.

Figure 2:
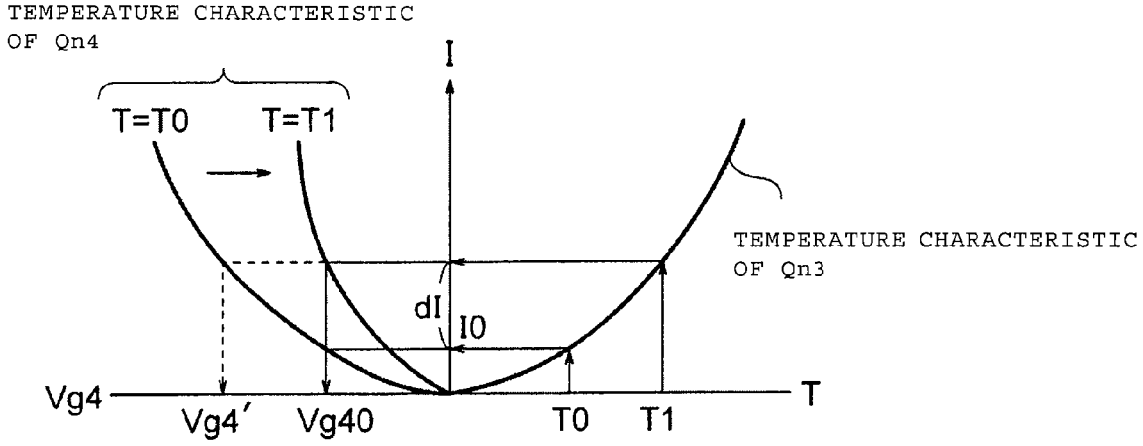
FIG. 2 is a view schematically illustrating temperature characteristics of transistors in the reference voltage generating circuit.

FIG. 2 is a view schematically illustrating temperature characteristics of the transistors Qn3, Qn4. To be more specific, FIG. 2 schematically illustrates the relationship between a temperature T, an electric current I that the transistor Qn3 flows and a gate voltage Vg4 of the transistor Qn4. As illustrated in a right half of the drawing, the higher a temperature T, the larger an electric current I that flows from the transistor Qn3 becomes. On the other hand, as illustrated in a left half of the drawing, the higher the temperature T, the lower a gate voltage Vg4 of the transistor Qn4 for flowing a certain electric current I0 becomes.

In FIG. 2, when the temperature is T0, an electric current I0 flows in the transistor Qn3, and the voltage Vg4 is Vg40 (Vg4=Vg40). When the temperature is increased from T0 to T1, the transistor Qn3 tends to flow a larger electric current (I0+dI). Assuming that the transistor Qn4 has no temperature dependency, the voltage Vg4 for flowing the electric current (I0+dI) becomes Vg4' that is higher than Vg40.

However, in this embodiment, the transistor Qn4 has the temperature characteristic illustrated in FIG. 2 and hence, a large electric current may flow through the transistor Qn4 even when the voltage Vg4 is low by an amount that the temperature T is increased. As a result, the voltage Vg4 for causing the electric current (I0+dI) flow is also set to Vg40. In this manner, by imparting the temperature characteristic that cancels the temperature characteristic of the transistor Qn3 to the transistor Qn4, a change in voltage Vg4, that is, a change in reference voltage Vref may be suppressed.

In order to impart such a temperature characteristic to the transistor Qn4, sizes or the like of the transistors Qn3, Qn4 may be properly adjusted. As one example, a ratio between a gate width and a gate length may be set to 1:3 with respect to the transistor Qn3, and a ratio between a gate width and a gate length may be set to 1:5 with respect to the transistor Qn4.

However, even when such adjustment is performed, there may be a case where it is not possible to completely cancel the temperature characteristic. Also in such a case, by providing the resistance element R1, it is possible to suppress a change in reference voltage Vref that occurs along with a change in temperature. The suppression of a change in reference voltage Vref is explained in detail hereinafter.

When it is not possible to completely cancel increase of an electric current that flows in the transistor Qn3 attributed to the increase of the temperature from T0 to T1 by the transistor Qn4, a reference voltage Vref is increased.

When a reference voltage Vref is applied to the gate electrode of the transistor Qn2 as a bias voltage without providing the resistance element R1, the increased reference voltage Vref is applied to the gate electrode of the transistor Qn2. As a result, an electric current that flows in the transistors Qn2, Qn3 is also increased. In this manner, when the resistance element R1 is not provided, it is difficult to suppress the increase of an electric current that flows in the transistor Qn3 and hence, the reference voltage Vref changes.

To the contrary, in this embodiment, the resistance element R1 is provided. Accordingly, when an electric current that flows in the transistor Qn3 is increased, due to a voltage drop in the resistance element R1, it is possible to lower a bias voltage Vb applied to the gate electrode of the transistor Qn2. Due to such lowering of the bias voltage Vb, a source voltage of the transistor Qn2 is also lowered. In this manner, a drain voltage of the transistor Qn3 (that is, a source voltage of the transistor Qn2) is lowered and hence, a source-drain voltage of the transistor Qn3 is decreased. As a result, the increase of an electric current that flows in the transistor Qn3 may be suppressed and, eventually, it is possible to suppress a change in reference voltage Vref.

A case may be considered where a source voltage of the transistor Qn2 is increased along with the increase of a temperature. In this case, by providing the resistance element R1, the effect of lowering a bias voltage Vb is decreased. Accordingly, a size of the transistor Qn2 is adjusted such that the increase of the source voltage is suppressed as much as possible even when the temperature is increased. To be more specific, the size of the transistor Qn2 is adjusted such that a voltage drop caused by the resistance element R1 becomes larger than the increase of the source voltage of the transistor Qn2 caused by the increase of the temperature.

From a viewpoint of suppressing temperature dependency of a reference voltage Vref, it is desirable to set the resistance value r of the resistance element R1 to be as large as possible. This is because the larger the resistance value r, the smaller an amount of change dVb of a bias voltage Vb becomes. On the other hand, when the resistance value r is excessively increased, the bias voltage Vb becomes excessively small and hence, the transistors Qn2, Qn4 are not turned on. In this case, an electric current does not flow in the transistor Qn3 and hence, a proper reference voltage Vref is not generated.

Accordingly, it is desirable to set the resistance value r of the resistance element R1 to be as large as possible within a range where the transistor Qn2 is turned on by a bias voltage Vb.

As has been described heretofore, in this embodiment, the reference voltage generating circuit 100 includes the resistance element R1. A bias voltage Vb smaller than a reference voltage Vref is generated by the resistance element R1. Accordingly, the reference voltage Vref having small temperature dependency may be generated.

Some modifications are explained hereinafter.

Figure 3:
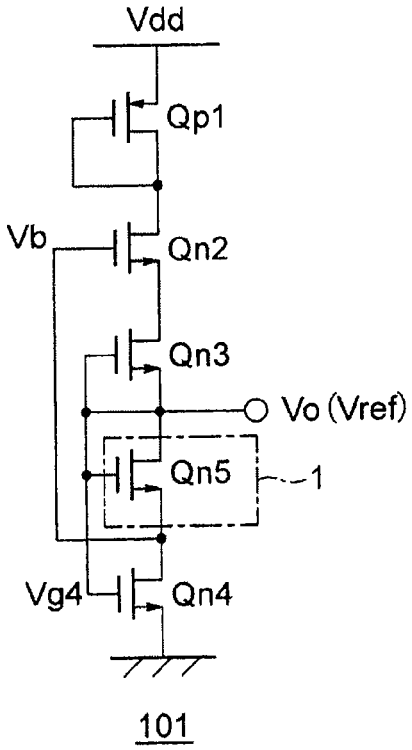
FIG. 3 is a circuit diagram illustrating a reference voltage generating circuit that is a first modification of the reference voltage generating circuit illustrated in FIG. 1.

FIG. 3 is a circuit diagram of a reference voltage generating circuit 101 according to a first modification of the reference voltage generating circuit 100 illustrated in FIG. 1. Unlike the reference voltage generating circuit 100 illustrated in FIG. 1, the reference voltage generating circuit 101 includes an enhancement-type n MOS transistor (fifth switching element) Qn5 that constitutes a bias voltage generating section 1. A drain electrode (second end) and a gate electrode (control end) of the transistor Qn5 are connected to a gate electrode of a transistor Qn3 (that is, output terminal Vo). A source electrode (first end) of the transistor Qn5 is connected to a drain electrode of a transistor Qn4. Further, a size of the transistor Qn5 is adjusted such that the increase of the source voltage is suppressed as much as possible even when a temperature is increased.

The transistor Qn5 performs substantially the same function as the resistance element R1 illustrated in FIG. 1 and hence, the operational principle of the reference voltage generating circuit 101 is substantially the same as the operational principle of the reference voltage generating circuit 100. That is, the transistor Qn5 generates a bias voltage Vb. In this case, the bias voltage Vb depends on a size and a threshold voltage of the transistor Qn5. Accordingly, a desired bias voltage Vb lower than a reference voltage Vref may be generated by adjusting the size and the threshold voltage of the transistor Qn5.

Even when a temperature is increased, as described above, a source voltage of the transistor Qn5 is not increased noticeably and, rather, a bias voltage Vb is lowered along with the increase of an electric current that flows from the transistor Qn3. Accordingly, the reference voltage generating circuit 101 may suppress temperature dependency of a reference voltage Vref in the same manner as the reference voltage generating circuit 100 illustrated in FIG. 1.

By using the transistor Qn5 in place of the resistance element, a circuit scale of the reference voltage generating circuit 101 may be made small compared to the reference voltage generating circuit 100 illustrated in FIG. 1.

Figure 4:
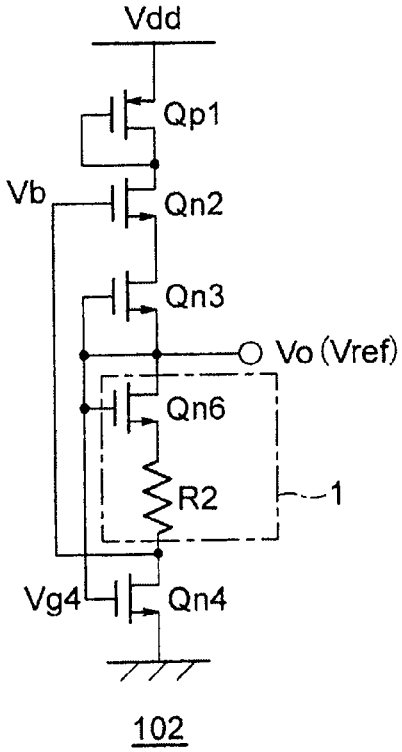
FIG. 4 is a circuit diagram illustrating a reference voltage generating circuit that is a second modification of the reference voltage generating circuit illustrated in FIG. 1.

FIG. 4 is a circuit diagram of a reference voltage generating circuit 102 according to a second modification of the reference voltage generating circuit 100 illustrated in FIG. 1. Unlike the reference voltage generating circuit 100 illustrated in FIG. 1 and the reference voltage generating circuit 101 illustrated in FIG. 3, the reference voltage generating circuit 102 includes an enhancement-type nMOS transistor (sixth switching element) Qn6 and a resistance element R2 that constitute a bias voltage generating section 1. The transistor Qn6 and the resistance element R2 are connected in series between a transistor Qn3 and a transistor Qn4.

To be more specific, a drain electrode (second end) and a gate electrode (control end) of the transistor Qn6 are connected to a gate electrode of a transistor Qn3 (that is, output terminal Vo). The resistance element R2 includes a first terminal connected to a source electrode (first end) of the transistor Qn6, and a second terminal connected to a drain electrode of the transistor Qn4. The reference voltage generating circuit 102 illustrated in FIG. 4 is the combination of the reference voltage generating circuit 100 illustrated in FIG. 1 and the reference voltage generating circuit 101 illustrated in FIG. 3 and hence, the operational principle of the reference voltage generating circuit 102 is substantially equal to the operational principles of the reference voltage generating circuits 100, 101.

In the reference voltage generating circuit 102, a bias voltage Vb may be roughly adjusted by adjusting a size and a threshold voltage of the transistor Qn6. Further, the bias voltage Vb may be finely adjusted by the resistance element R2. A circuit scale of the reference voltage generating circuit 102 may be decreased by using the transistor Qn6, and the bias voltage Vb may be set to a desired value with high accuracy by using the resistance element R2.

As has been described heretofore, a bias voltage smaller than a reference voltage is generated by providing the bias voltage generating section in the reference voltage generating circuit. Accordingly, a reference voltage having small temperature dependency may be generated.

The reference voltage generating circuits illustrated in FIG. 1, FIG. 3 and FIG. 4 are examples, and various modifications are conceivable with respect to the reference voltage generating circuit according to this embodiment. For example, it may be possible to provide a reference voltage generating circuit where conductivity types of the respective transistors may be reversed from the conductivity types of the transistors in the reference voltage generating circuits illustrated in FIG. 1, FIG. 3 and FIG. 4, and then connection positions where the transistors are connected with the power source terminal and the ground terminal may be reversed. Such a reference voltage generating circuit also uses the same basic operational principle.

In the above-mentioned respective embodiments, the case is exemplified where a depletion MOS transistor is used as a normally-on type switching element, that is, as a switching element into which an electric current flows when a control end and a first end have the same potential. However, other elements such as a normally-on type GaN High Electron Mobility Transistor (HEMT) may also be used as a normally-on type switching element in place of the depletion MOS transistor.

In the same manner, in the above-mentioned respective embodiments, the case is exemplified where an enhancement-type MOS transistor is used as a normally-off type switching element, that is, as a switching element into which an electric current does not flow when a control end and a first end have the same potential. However, other elements such as a normally-off type GaN HEMT may also be used as a normally-off type switching element in place of the enhancement-type MOS transistor.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A reference voltage generating circuit comprising:

a first switching element of a first conductivity type having a first end connected to a first terminal, and a second end short-circuited to a control end thereof;

a second switching element of a normally-on type and of a second conductivity type having a first end, a second end connected to the second end of the first switching element, and a control end to which a bias voltage is applied;

a third switching element of the normally-on type and of the second conductivity type having a first end short-circuited to a control end thereof and connected to a reference voltage output terminal, and a second end connected to the first end of the second switching element;

a bias voltage generating section configured to generate the bias voltage that is lower than the reference voltage from the reference voltage; and a fourth switching element of a normally-off type and of the second conductivity type having a first end connected to a second terminal, a second end to which the bias voltage is applied, and a control end connected to the control end of the third switching element.

2. The reference voltage generating circuit according to claim 1, wherein the bias voltage generating section includes a first resistance element provided between the third switching element and the fourth switching element.

3. The reference voltage generating circuit according to claim 1, wherein the bias voltage generating section includes a fifth switching element provided between the third switching element and the fourth switching element, a control end of the fifth switching element being connected to the reference voltage output terminal.

4. The reference voltage generating circuit according to claim 1, wherein the bias voltage generating section includes a fifth switching element and a resistance element having a first end and a second end at which the bias voltage is generated, the fifth switching element having a first end connected to the first end of the resistance element and second and control ends that are connected to the reference voltage output terminal.

5. The reference voltage generating circuit according to claim 1, wherein the first terminal is connected to a power supply and the second terminal is connected to ground.

6. The reference voltage generating circuit according to claim 1, wherein the first switching element is a p-type MOS transistor, and the second, third, and fourth switching elements are n-type MOS transistors.

7. The reference voltage generating circuit according to claim 6, wherein a ratio between a gate width and a gate length of the third switching element is 1:3 and a ratio between a gate width and a gate length of the fourth switching element is 1:5.

8. The reference voltage generating circuit according to claim 1, wherein the fourth switching element has a temperature characteristic that cancels a temperature characteristic of the third switching element.

9. A reference voltage generating circuit comprising:

a first switching element of a first conductivity type having a first end connected to a first terminal, and a second end short-circuited to a control end thereof;

a second switching element of a normally-on type and of a second conductivity type having a first end, a second end connected to the second end of the first switching element, and a control end to which a bias voltage is applied;

a third switching element of the normally-on type and of the second conductivity type having a first end short-circuited to a control end thereof and connected to a reference voltage output terminal, and a second end connected to a first end of the second switching element;

a bias voltage generating section that includes a first resistance element having a first end connected to the first end of the third switching element and a second end at which the bias voltage is generated, the second end being connected to the control end of the second switching element; and a fourth switching element of a normally-off type and of the second conductivity type having a first end connected to a second terminal, a second end to which the bias voltage is applied, and a control end connected to the control end of the third switching element.

10. The reference voltage generating circuit according to claim 9, wherein the bias voltage generating section is configured to generate the bias voltage in accordance with a resistance value of the first resistance element.

11. The reference voltage generating circuit according to claim 10, wherein the resistance value of the first resistance element is set to a value at which the second switching element and the fourth switching element are turned on in accordance with the bias voltage.

12. The reference voltage generating circuit according to claim 9, wherein the bias voltage generating section further includes a fifth switching element of the normally-off type and of the second conductivity type provided between the first resistance element and the fourth switching element.

13. The reference voltage generating circuit according to claim 9, wherein the first terminal is connected to a power supply and the second terminal is connected to ground.

14. The reference voltage generating circuit according to claim 9, wherein the first switching element is a p-type MOS transistor, and the second, third, and fourth switching elements are n-type MOS transistors.

15. The reference voltage generating circuit according to claim 14, wherein a ratio between a gate width and a gate length of the third switching element is 1:3 and a ratio between a gate width and a gate length of the fourth switching element is 1:5.

16. The reference voltage generating circuit according to claim 9, wherein the fourth switching element has a temperature characteristic that cancels a temperature characteristic of the third switching element.

17. A reference voltage generating circuit comprising:

a first MOS transistor of a first conductivity type having a first end connected to a first terminal, and a second end short-circuited to a control end thereof;

a second MOS transistor of a normally-on type and of a second conductivity type having a first end, a second end connected to the second end of the first MOS transistor, and a control end to which a bias voltage is applied;

a third MOS transistor of the normally-on type and of the second conductivity type having a first end short-circuited to a control end thereof and connected to a reference voltage output terminal, and a second end connected to the first end of the second MOS transistor;

a fourth MOS transistor of a normally-off type and of the second conductivity type having a first end at which the bias voltage is generated, a second end connected to the reference voltage output terminal, and a control end connected to the control end of the third MOS transistor; and a fifth MOS transistor of the normally-off type and of the second conductivity type having a first end connected to a second terminal, a second end to which the bias voltage is applied, and a control end connected to the control ends of the third and fourth MOS transistors.

18. The reference voltage generating circuit according to claim 17, wherein the first terminal is connected to a power supply and the second terminal is connected to ground.

19. The reference voltage generating circuit according to claim 17, wherein a ratio between a gate width and a gate length of the third switching element is 1:3 and a ratio between a gate width and a gate length of the fifth switching element is 1:5.

20. The reference voltage generating circuit according to claim 17, wherein the fifth MOS transistor has a temperature characteristic that cancels a temperature characteristic of the third switching element.

* * * * *